United States Patent [19]

Brown

[11] Patent Number: 4,531,121

[45] Date of Patent: Jul. 23, 1985

[54] ELECTROMECHANICAL DISCRETE ELEMENT AND A LARGE SIGN OR DISPLAY

[75] Inventor: Brent W. Brown, Smithfield, Utah

[73] Assignee: Integrated Systems Engineering, Inc., Logan, Utah

[21] Appl. No.: 437,602

[22] Filed: Oct. 29, 1982

[51] Int. Cl.[3] ..... G09G 3/34

[52] U.S. Cl. ..... 340/764; 340/783; 340/815.07; 340/815.24; 340/815.27

[58] Field of Search ..... 340/815.1, 815.27, 815.29, 340/764, 815.05, 815.24, 815.07, 783

[56] References Cited

U.S. PATENT DOCUMENTS

| | | | |
|---|---|---|---|
| 3,161,726 | 12/1964 | Todt | 340/764 |
| 3,166,635 | 1/1965 | Todt | 340/764 |
| 3,266,033 | 8/1966 | Frohbach | 340/815.27 |
| 3,304,549 | 2/1967 | Aiken | 340/815.27 |
| 3,381,291 | 4/1968 | Simshauser | 340/815.24 |
| 3,581,301 | 5/1971 | Stutz et al. | 340/764 |
| 3,792,540 | 2/1974 | Watanabe et al. | 340/815.24 |
| 3,812,490 | 5/1974 | Goodrich | 340/764 |
| 3,963,326 | 6/1976 | Buchert | 340/815.07 |

*Primary Examiner*—Gerald L. Brigance
*Attorney, Agent, or Firm*—Lynn G. Foster

[57] ABSTRACT

A visual display element, which may be used singly or as part of a large bank or like and similar elements, each element comprising an encasement, a slotted plate, and an actuating assembly. The actuating assembly comprises a planar face with a colored pattern of lines thereon and is situated immediately behind and parallel to the slotted plate. When viewed from the front, the planar face and adjacent slotted plate, the slots of said plate comprising highly reflective surfaces, which collectively appear as a solid color. Selective relative movement between the planar face and the slotted plate causes the visually perceived color to change from one color to a contrasting color and thereafter back to the original color.

7 Claims, 9 Drawing Figures

ELECTROMECHANICAL DISCRETE ELEMENT AND A LARGE SIGN OR DISPLAY

BACKGROUND

1. Field of Invention

The present invention relates generally to display or indicating devices, and more particularly to a novel display device and a combination of such devices wherein the solid color of a visually perceived area of each device is selectively changed by the relative movement between a planar, colored face and a highly reflective slotted plate.

2. Prior Art

Prior art optical display devices known to the Inventor comprise two general classes of construction. In one class, the displayed symbols emit light by operating in conjunction with separate illuminating sources and thereby distinguish the symbol from the background. A typical arrangement is one in which the characters or symbols are displayed in white on a dark background and thus provide the necessary contrast by which they are distinguished from the adjacent surroundings.

In the other class of display devices, no light is emitted from the display. Such devices typically comprise an array of display members which take the form of cylinders, discs, or other shapes, but each characterized by two visually distinguishable display surfaces. These prior art devices are generally exemplified by the devices shown in U.S. Pat. Nos. 3,140,553; 3,283,427; 3,295,238; 3,365,824; 3,303,494; and 3,624,941. The most common arrangement is to use rotating magnetized discs which turn as the polarity of an electromagnet is changed. U.S. Pat. No. 3,469,258 discloses the use of a reversibly magnetizable permanent magnet exterior to the magnetically actuable visual member which allows the exterior field to be switched by the use of a pulse in the energizing windings for the exterior magnet so that the remnant field thereby produced in the exterior magnet retains the magnetically actuable element in position without the necessity of a sustaining current.

A problem encountered using the rotating visual members with two distinct and contrastingly colored sides has been the generation of the initial torque necessary to rotate the visual member when the polarity of the electromagnet is reversed. Attempted solutions to this problem are exemplified by U.S. Pat. Nos. 3,295,238; 3,518,664; and 3,991,496.

BRIEF SUMMARY AND OBJECTS OF THE INVENTION

Visual display devices according to the present invention comprise an electromagnetically actuable element which is selectively moved to achieve a desired visual effect. The presently preferred embodiment of the invention, as more fully described hereinafter, illustrates a relative movement between a visual face and a slotted face, the amount of movement defined by the size of colored bands emplaced upon the visual face.

In the illustrated embodiment, reversibly magnetizable magnets are used in conjunction with permanent magnets, polarity of said reversible magnets periodically switched by the use of a pulse in the energizing windings so that a remnant magnetic field is thereby produced which retains the display face in position without the necessity of a sustaining current. In this way, the face is shifted from one position to the other. The presently preferred display device comprises two such reversibly magnetizable magnets which act in conjunction with magnetized beryllium pellets permanently mounted to display face extensions, which retain the face in either selected position.

The display face preferably comprises a material upon which uniformly alternately spaced, opaque or translucent color strips exist. Illumination of the visual device is not critical; but, if desired, a light source situated behind the display element or a plurality of elements may be employed to illuminate the translucent material of the display face. This arrangement is particularly helpful for night use.

With the foregoing in mind, it is a primary object of the present invention to provide a novel display element and related method.

It is also a principal object of the present invention to provide a novel electromechanical display element wherein a contrasting visual effect is created by the relative movement between a slotted plate and a visual face.

Another principal object is to provide a novel display element wherein a visual face is displaced by flexing a resilient member.

It is an important object to provide a novel display element which is selectively actuated by use of reversible magnetizable magnets that retain the moving portion thereof in a selected position without the necessity of a sustaining current.

It is a paramount object of the present invention to provide a novel element the face of which may be selectively illuminated by use of an external light situated to the rear of a single display element or a plurality of elements, illuminating translucent areas of the visual face.

It is a further important object to provide a novel display element wherein at least the actuating portion is contained in a transparent casing.

These and other objects and features of the present invention will be apparent from the following detailed description, taken with reference to the accompanying drawings.

DETAILED DESCRIPTION OF THE ILLUSTRATED EMBODIMENT

Reference is now made to the drawings wherein like numerals are used to designate like parts throughout. Specific reference is made to FIG. 7, which illustrates a display element, in accordance with the present invention which is generally designated 11. Element 11 comprises a transparent encasement or lens, generally designated 12, a slotted face plate, generally designated 14, and an actuating assembly generally designated 16, the structure and functions of which will be more fully described hereinafter.

Figure 1:
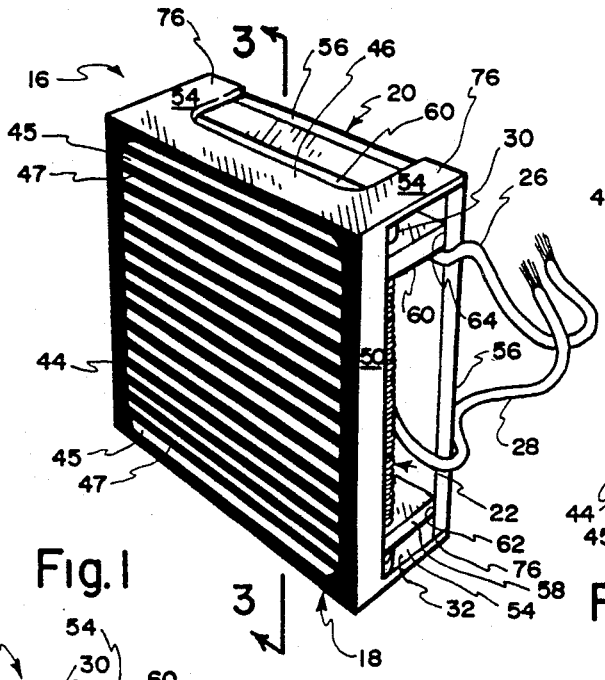
FIG. 1 is a perspective view of a presently preferred actuating assembly according to the present invention before insertion into a transparent encasement, with a stripped plate forming a visual display module.
Figure 2:
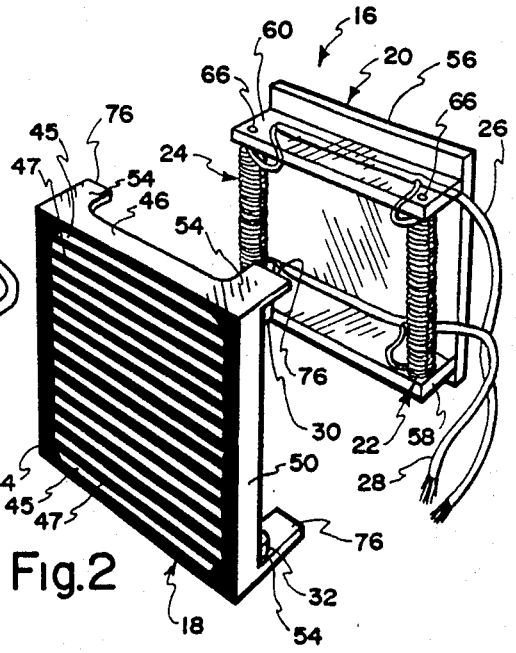
FIG. 2 is a partially exploded perspective of the actuating assembly of FIG. 1.
Figure 3:
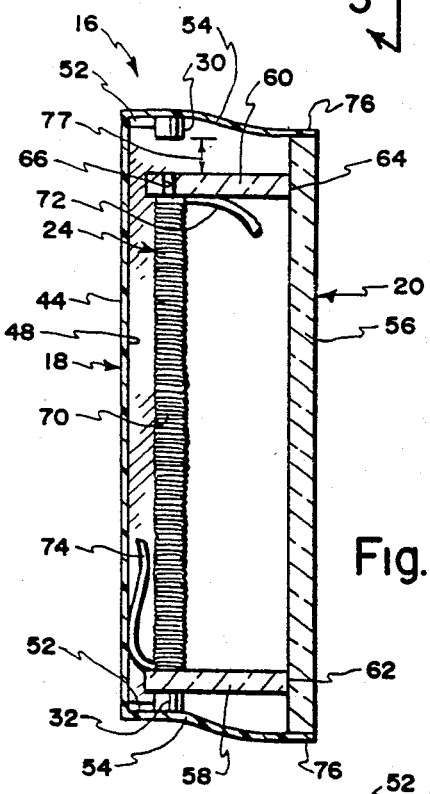
FIG. 3 is a cross sectional view of the actuating assembly taken along line 3—3 of FIG. 1.

Referring to FIGS. 1–3, the actuating assembly 16 is illustrated by itself and comprises a punched and folded translucent vertically oriented face plate, generally designated 18, a rigid vertical base, generally designated 20, two spaced electromagnets 22 and 24, wires 26 and 28 and permanent magnets 30 and 32.

Punched and folded translucent face plate 18, is formed by punching and cutting such as a blank from a large sheet of resilient material. Presently a plastic sheet material comprising Mylar is preferred, which folds and creasess and yet is highly flexible and resilient acccommodating an infinite amount of flexing, as herein more fully explained. Such material is also easily silk screened.

Figure 6:
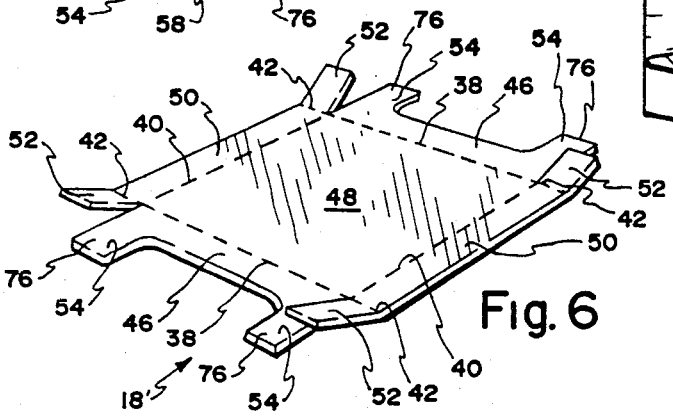
FIG. 6 is a perspective view of a blank of yieldable plastic used to form the visual plate of the device of FIG. 1, prior to formation of any stripes thereon.

The dotted lines 38, 40 and 42 of FIG. 6 indicate where blank 18' is folded and creased to form the essentially perpendicular wall structure, as shown in FIGS. 1, 2 and 3. Prior to folding, however, the face 44 of blank 18' is silk screened so that uniformly spaced parallel rows or bars of a color which contrasts with the color of blank 18' are placed thereon. The vertical width of each silk screened bar is essentially equal to the vertical space between each two adjacent bars.

After the silk screening process has been completed the blank 18 is transformed into face plate 18 by folding end flaps 46 along fold line 38 toward back side 48 and creasing the fold until the flaps are at right angles with the front face thereof. Side flaps 50 are next folded and creased along lines 40 until the flaps are at right angles to the front face thereof. End tabs 52 of side flaps 50 are each folded and creased along line 42 and are securedly attached to end flaps 46 by bonding or the like, the completion of this step causing plate 18 to be a rigid box-shaped unit shown in FIG. 2.

Permanent disc-shaped magnets 30 and 32 comprise rubberized beryllium pellets. Magnets 30 and 32 are attached by bonding or the like to plate 18 in axial alignment with each electromagnet 22, 24 as shown in FIG. 3. Magnets 30 and 32 are specifically mounted and attached to the exposed side of flaps 54 uniformly so that, for example, if the south pole of magnet 30 is attached to the upper flap 54, then the south pole of magnet 32 will be attached to the aligned lower flap 54.

Base 20 comprises a transparent, solid rectangular vertically directed planar member 56 and two spaced horizontally directed cantilevered support members 58 and 60. Support members 58 and 60 are attached securedly to base plate 56 at sites 62 and 64 by bonding or the like. Support members 58 and 60 are parallel to one another and serve to carry electromagnets 22 and 24 in their illustrated positions. Two apertures 66 are provided in each support members 58 and 60 at spaced locations aligned with magnets 30 and 32 to allow the passage therethrough of core 68 of electromagnets 22 and 24.

Electromagnets 22 and 24 are aligned parallel to both display face 44 of plate 18 and base plate 56. Electromagnets 22 and 24 comprise a slender cylindrical core 68 wrapped by a conductive coil 70, said coil having conductive ends 72 and 74. Each electromagnet 22 and 24 is aligned and emplaced with core 68 thereof slidably pasing through its two associated apertures 66 of support members 58 and 60. The two ends 72 are spliced into wire 26 and ends 74 are spliced into wire 28.

Plate 18 is attached to base 20 only by flaps 54 and, more specifically, at ends 76 of flaps 54. Attachment by bonding is presently preferred. The attachment at sites 76 allows flaps 54 to flex as plate 18 linearly reciprocates under the forces created by the interaction of electromagnets 22 and 24 and permanent magnets 30 and 32.

Movement of plate 18 from either position to the other is accomplished by pulsing a current through the coil 70 of electromagnets 22 and 24 which reverses the polarity of each coil 70. Both electromagnets 22 and 24 always drive in the same direction at any one time, the supply voltage in such coils being preferably 40 volts and induction saturation occurring in 300 microseconds. It should be appreciated, however, that other reversible magnet systems could be used satisfactorily with the visual display element of the present invention.

As mentioned previously, folded and creased plate 18 is only attached to the back plate 20 at the four ends 76. This allows the four tabs 54 to flex, said ends 54 comprising a highly flexible resilient and fatigue material. For example, Mylar has a life of 500 million to one billon cycles. No friction bearing surfaces are needed.

It must be understood that the size of gap 77 between permanent magnet 30, 32 and electromagnets 22, 24 is critical for the proper operation of apparatus 11. The size of gap 77 is determined by and equal to the width of each bar 45, 47 on face 44.

Figure 5:
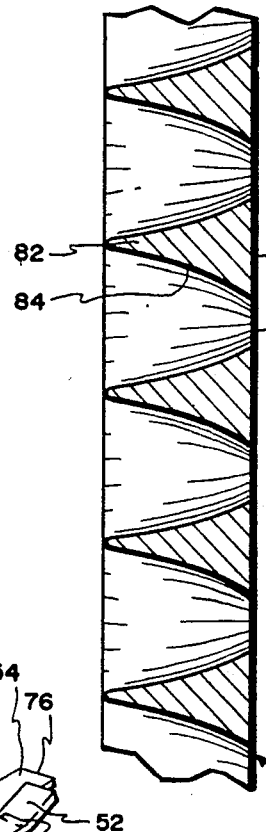
FIGS. 4 and 5 are both elevated cross sectional views of different sizes of the slotted face plate, illustrating the curvalinear faces of the slots thereof.
Figure 4:
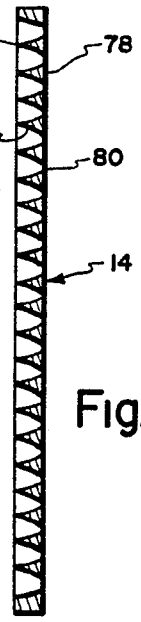

Referring to FIGS. 4 and 5, slotted face plate 14 is generally coextensive with and closely spaced from striped face 44 of plate 18. Rear surface 78 of slotted face plate 14 is juxtaposed face 44 in the assembled condition. Parallel horizontally directed slots 80 are disposed in surface 78. Parallel ridges 82, the cross section of which generally decrease as they extend away from face 44, are disposed between slots 80. The sloping surfaces 84 of members 82 are curvilinear and are coated with a highly reflective material, such as chrome, to enhance the visual effect of the element.

Figure 7:
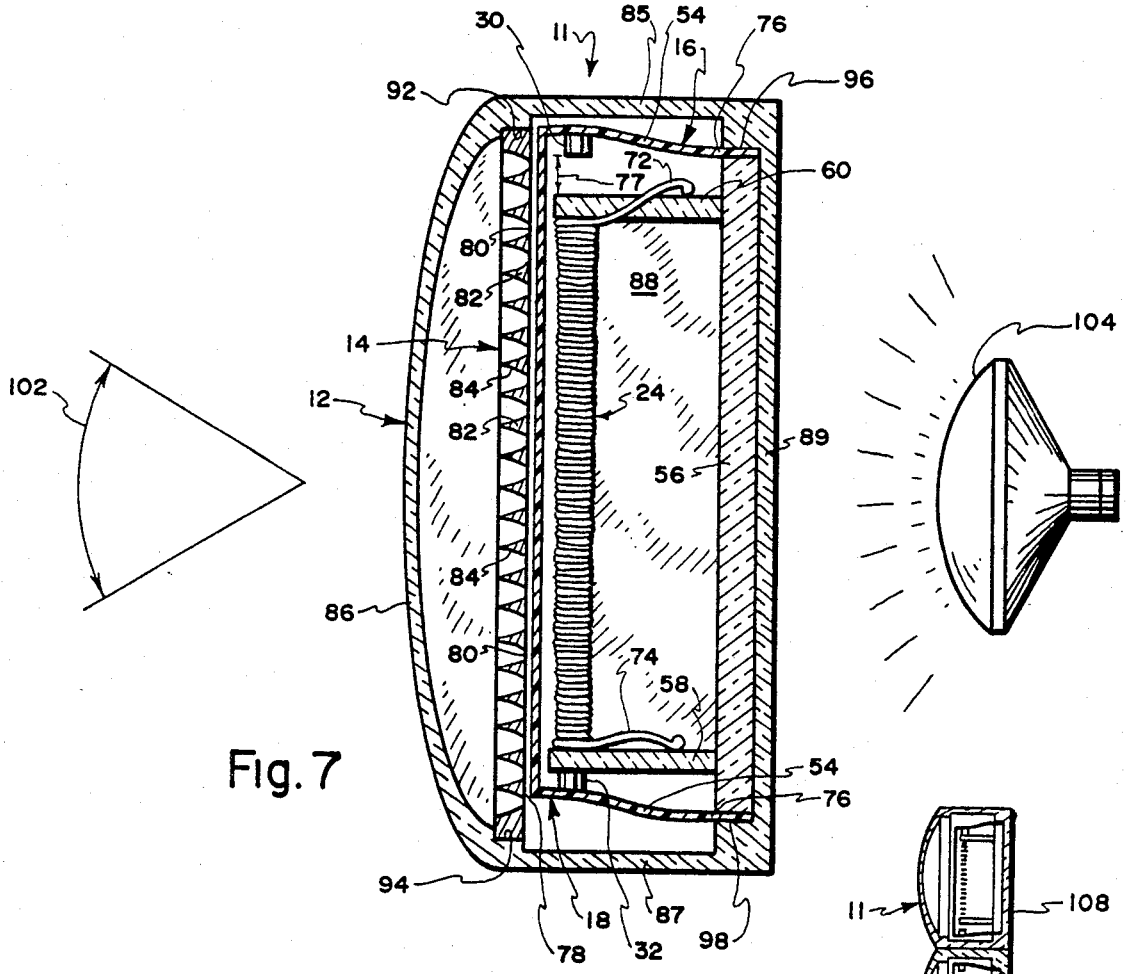
FIG. 7 is a cross sectional view of the visual display element of FIG. 1 having the slotted face plate and a transparent lens installed.

Transparent encasement 12, as illustrated in FIG. 7 comprises a curved face or lens member 86 and side members 88. Member 86 merges with transparent top and bottom encasement walls 85 and 87, which in turn respectively merge with rear encasement wall 89. Encasement 12 provides a housing for slotted faceplate 14 and actuating assembly 16, thereby substantially excluding dust, etc.

Slotted face plate 14 is positioned in encasement 12 at matches 92 and 94 by lateral insertion and is subsequently securedly attached thereat by bonding or the like.

Actuating assembly 16 is positioned within encasement 12 by lateral insertion so that base plate 56 and tabs 54 at end 76 are interposed between notches 96 and 98, said assembly 16 being securedly attached by bonding and the like, for example, immediately behind base plate 14. Once slotted face 14 and the actuating assembly 16 are emplaced within encasement 12, sides 88 are assembled and bonded or the like to close the encasement 12, wires 26 and 28 being the only members protruding through encasement 12.

Angle 102 in FIG. 7 illustrates a typical angle in which the color exposed at the opening 80 is visualized. By varying the curvalinear slot 80, 84, the viewing area and angle of view will correspondingly vary. Angle 102 is preferably 30° to 40°, which causes the color bars exposed at openings 80 to have the appearance of one solid color across the entire face 14.

Figure 8:
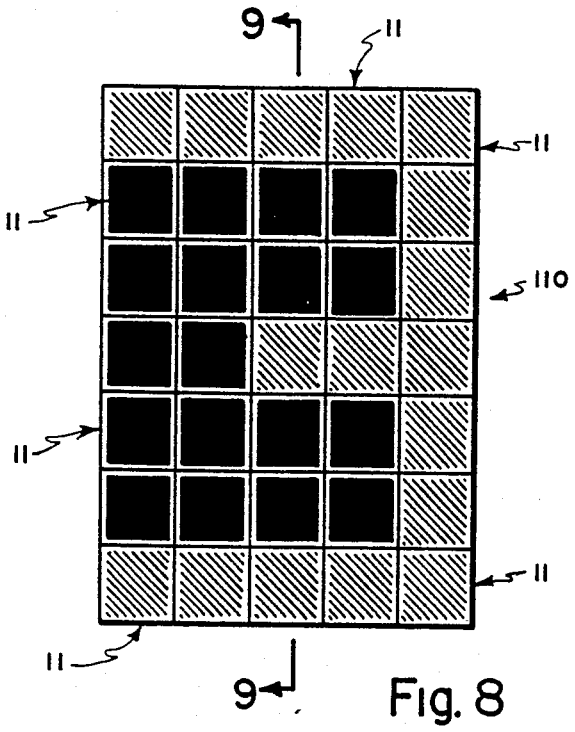
FIG. 8 illustrates in front elevation an array of elements according to the present invention.
Figure 9:
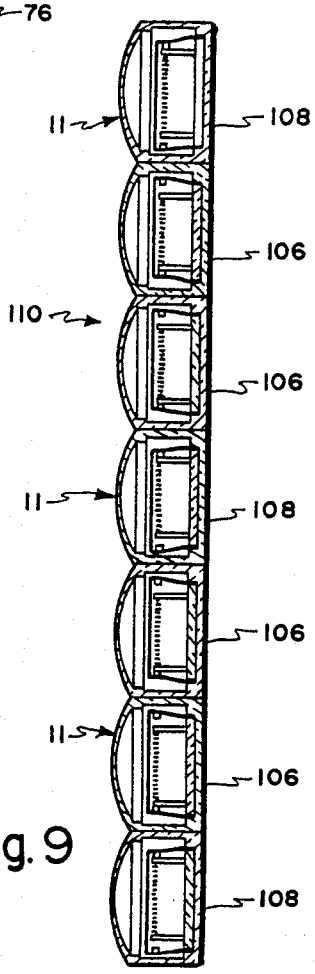
FIG. 9 is a cross sectional view of the display bank of FIG. 8 taken along line 9—9 thereof.

Although each display element 11 is an independent unit, a plurality of such modules may be assembled as illustrated in FIGS. 8 and 9 to form a large coordinated display 110. It should be noted that each visual display element does not have an independent light source. Light source 104, when and if needed, may be situated substantially to the rear of several elements 11. During daylight operation the contrasting colors of face 44 are easily distinguishable, reflective surfaces 84 enhancing the illusion of one solid block of color per module during any particular mode of operation.

Background lighting is completely optional; but, due to the translucent qualities of the Mylar used for plate 18, background lighting will ordinarily be beneficial for night viewing. This saves on operating costs in that effective operation of the display device during daylight without the use of a power consuming light source is possible and yet the advantages of an illuminated display device during night time hours are retained.

It is presently contemplated that the large visual display apparatus 110 will be used in the form of a grid series, as illustrated in FIGS. 8 and 9. The initial or at rest position of actuating assembly 16 will allow, for example, the darker bars 47 to be viewed through slotted plate 14. When actuated the light bars 45 are exposed to view. Each module will be connected to a control mechanism which will allow the operator to selectively activate each assembly 16 to accomplish the desired visual effect in a manner well known in the art.

FIG. 9 shows a vertical row of grid display apparatus 110 of FIG. 8, illustrating some modules 108 in their actuated position and other modules 106 in their non-actuated positions. It is only between these two positions that the face 44 reciprocates in the presently preferred embodiment, were reciprocation being completed within 15–20 milliseconds. Each module is returned to its original position by application of a current pulse in a direction opposite to that used originally to acutate the module. It is to be appreciated that only a short current pulse is necessary and that continuous electrical power is not required.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by U.S. Letters Patent is:

1. A compact ambient light lampless visual display discrete element having a display area comprising:

a first member comprising a generally flat display face exhibiting alternate similarly dimensioned parallel bands of two contrasting colors, the display face being disposed in a first plane and being reciprocable relative to a second member;

said second member comprising a thin slotted colored band reflecting plate comprising alternate similarly dimensioned parallel open slots and elongated display face masking bars, the plate being disposed in a second plane immediately juxtaposed and essentially parallel to the first plane, the slots and bars extending in parallel, though alternate relationship, each slot and bar being sized, shaped and located so that the display face bands of one color are collectively forwardly exposed at the slots while the display face of the second color are collectively rearwardly concealed by the bars, at any point in time;

the bars comprising exposed forwardly divergently tapered transversely elongated reflective surfaces juxtaposed and extending forward from each slot whereby a portion of ambient light striking the exposed bands displaying one color is first reflected from the bands and thereafter again reflected from the divergently tapered transversely elongated reflective surfaces adjacent each slot such that the apparent width of each exposed band comprising one color is substantially increased and the entire display area of the discrete element appears to the eye of an observer to be essentially of one homogenuous color, without material interruption;

support means which carry the first and second members in said relative reciprocable relationship and in said juxtaposed planes;

single pulse responsive actuator means carried by the support means for relatively rectilinearly reciprocating the display face and the reflective plate between two positions through a distance essentially equal to the width of one band, the actuator means being immediately juxtaposed the rear of the display face and in essentially parallel relationship thereto;

the actuator means comprising electromechanical means, comprising core means and coil means surrounding the core means, and first and second permanent magnet means, the polarity of the core means being reversed by an appropriate current pulse through the surrounding coil means, the first and second permanent magnet means being in alignment with the core means, one permanent magnet means being juxtaposed one end of the core means, and the other permanent magnet means being juxtaposed the other end of the core means, there being a cumulative gap between the core means and the two permanent magnet means essentially equal to the width of one said color band, one of the electromagnetic means or the two permanent magnet means being electromagnetically rectilinearly reciprocated by the pulse-created change in polarity, the pole orientation of the first and second permanent magnet means magnetically causing the core means to shift from contiguous engagement with one permanent magnet means to the other upon each pulse created change in polarity to thereby rectilinearly reciprocate the reciprocable member, and the other of the electromagnetic means and two permanent magnet means being held in a stationary position by the support means.

2. A lampless visual display discrete element according to claim 1 wherein the pairs of forwardly divergent reflective surfaces each comprises a curvilinear, forwardly tapered transversely elongated throat surface immediately in front of each slot in the plate.

3. A lampless visual display discrete element according to claim 1 further comprising encasement means at least part of which is transparent, the encasement means substantially enclosing the remainder of the discrete element.

4. A lampless visual display discrete element according to claim 1 wherein the core means comprise at least one elongated solid core post.

5. A visual display discrete element according to claim 1 further comprising background lighting means.

6. A lampless electromechanical visual display discrete element comprising:

support means;

slender electromagnetic means the polarity of which is reversed only by an electrical pulse, the slender electromagnetic means being carried by the support means;

two permanent magnet means, each carried by the support means at opposite ends of and aligned with the slender electromagnet means which act and react in response to the polarity of the electromagnet means at any point in time to relatively rectilinearly displace the electromagnetic means from one permanent magnet means to the other each time a pulse changes the polarity of the slender electromagnetic means;

visual face means, each carried by the support means comprising alternating bands of two contrasting colors uniformly displayed thereon, the face means being disposed in a plane which is immediately juxtaposed and parallel to the orientation of the slender electromagnetic means;

plate means, each carried by the support means, in relatively linear reciprocable relation with respect to the face means, comprising a plurality of slots therethrough which expose only the bands of one color at any point in time and tapered reflective elongated slot surfaces whereby the apparent width of each exposed band is reflectively increased such that the entire display appears to the eye of an observer to be one homogenuous color or the contrasting color at any point in time.

7. A lampless electromechanical visual display discrete element comprising:

support means;

electromagnetic means the polarity of which is reversed only by an electrical pulse, the electromagnetic means being carried by the support means;

two permanent magnet means, each carried by the support means at opposite ends of and aligned with the electromagnet means which act and react in response to the polarity of the electromagnet means at any point in time to relatively rectilinearly displace the electromagnetic means from one permanent magnet means to the other each time a pulse changes the polarity of the electromagnetic means;

visual face means, each carried by the support means comprising alternating bands of two contrasting colors uniformly displayed thereon, the face means being disposed in a plane which is immediately juxtaposed the electromagnetic means;

plate means, each carried by the support means, in relatively linear reciprocable relation with respect to the face means, comprising a plurality of elongated slots therethrough which expose only the bands of one color at any one point in time and reflective elongated surfaces adjacent each slot whereby the apparent width of and area covered by each exposed band is reflectively increased such that the entire display appears to the eye of an observer to be one color or the other contrasting color at any point in time.

* * * * *